US007290645B2

(12) United States Patent
Hill et al.

(10) Patent No.: US 7,290,645 B2
(45) Date of Patent: Nov. 6, 2007

(54) SEPARATING FOREIGN OBJECTS FROM A MASS OF COINS

(75) Inventors: Timothy W. Hill, Shrewsbury (GB); Simon Scott Brown, Edgmond (GB)

(73) Assignee: Scan Coin Industries AB, Malmo (SE)

( * ) Notice: Subject to any disclaimer, the term of this patent is extended or adjusted under 35 U.S.C. 154(b) by 551 days.

(21) Appl. No.: 10/670,111

(22) Filed: Sep. 24, 2003

(65) Prior Publication Data

US 2004/0097182 A1 May 20, 2004

Related U.S. Application Data

(60) Provisional application No. 60/414,486, filed on Sep. 27, 2002, provisional application No. 60/448,323, filed on Feb. 19, 2003.

(30) Foreign Application Priority Data

Sep. 27, 2002 (GB) ..... 0222439.2
Feb. 14, 2003 (GB) ..... 0303434.5

(51) Int. Cl.
*G07F 1/00* (2006.01)
*G07F 1/04* (2006.01)

(52) U.S. Cl. ..... 194/347

(58) Field of Classification Search ..... 194/347, 194/348; 209/680, 682, 309, 311, 314, 315, 209/320, 322, 920; 453/5, 63; 198/761, 198/762, 750.1, 752.1
See application file for complete search history.

(56) References Cited

U.S. PATENT DOCUMENTS 269,461 A * 12/1882 Rakestaw ..... 209/35

(Continued)

FOREIGN PATENT DOCUMENTS

WO WO 96/30877 10/1996

(Continued)

OTHER PUBLICATIONS

Scan Coin AB, "Scan Coin 4000 Value Sorter" and product photos, on sale in the U.S. prior to Sep. 2001.

(Continued)

*Primary Examiner*—Patrick Mackey
*Assistant Examiner*—Mark J. Beauchaine
(74) *Attorney, Agent, or Firm*—Womble Carlyle Sandridge & Rice, PLLC

(57) ABSTRACT

A coin cleaning device for separating foreign objects from a mass of coins, comprising first and second shelf portions arranged at first and second heights, vibration means for vibrating both the first and second shelf portions to cause coins on said shelf portions to be conveyed along said shelf portions, said shelf portions each being perforated by apertures of transverse dimensions smaller than a predetermined minimum diameter of coins to be handled by the device, whereby foreign matter of transverse dimensions smaller than the perforations can fall through said perforations, said first shelf portion having an upstream end and a downstream end, said second shelf portion having an upstream end and a downstream end, said shelf portions being arranged in series with one another whereby coins fall from said downstream end of said first shelf portion to tumble downwards to lie on said upstream end of said second shelf portion, and a coin outlet positioned beneath said downstream end of said second shelf portion whereby coins conveyed along said second shelf portion fall into said coin outlet.

16 Claims, 9 Drawing Sheets

U.S. PATENT DOCUMENTS

| | | | | |
|---|---|---|---|---|
| 545,185 | A * | 8/1895 | Yost | 209/253 |
| 1,345,858 | A * | 7/1920 | Jenkins | 209/404 |
| 3,147,839 | A | 9/1964 | White, Jr. | 194/100 |
| 4,092,990 | A | 6/1978 | Bayne | |
| 5,100,367 | A | 3/1992 | Abe | |
| 5,746,322 | A * | 5/1998 | LaVeine et al. | 209/393 |
| 5,842,916 | A | 12/1998 | Gerrity et al. | 453/57 |
| 6,053,807 | A * | 4/2000 | Metzger et al. | 453/57 |
| 6,068,550 | A | 5/2000 | Breitholtz et al. | 453/17 |
| 6,174,230 | B1 | 1/2001 | Gerrity et al. | |
| 6,179,703 | B1 | 1/2001 | Knutsson et al. | 453/3 |
| 6,484,884 | B1 * | 11/2002 | Gerrity et al. | 209/233 |
| 6,666,318 | B2 | 12/2003 | Gerrity et al. | |
| 6,863,168 | B1 | 3/2005 | Gerrity et al. | |

FOREIGN PATENT DOCUMENTS

| | | |
|---|---|---|
| WO | WO 97/33257 | 9/1997 |

OTHER PUBLICATIONS

Scan Coin 4000 Value Sorter, Operator's Instruction Manual, published before Sep. 2001.

SC4000 Coin Discriminating System, Including Perforated, Vibrating Coin Feeding and Cleaning Tray Assembly; On sale in the US by Scan Coin Since at least as early as Dec. 1994 (including photographs, drawings and parts lists).

Scan Coin 4000 Value Sorter Operator's Instruction Manual—1995.

* cited by examiner

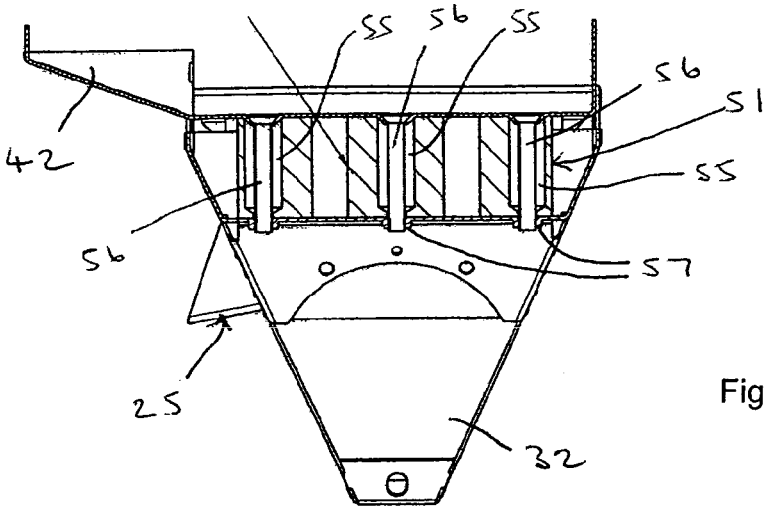
Figure.11
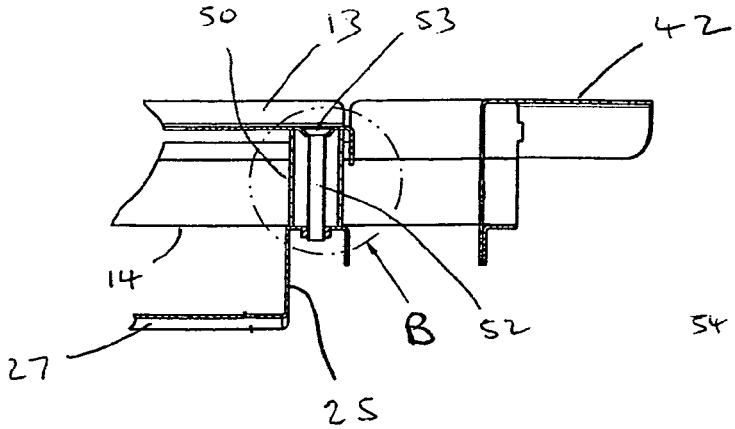
Figure 12
Figure 13
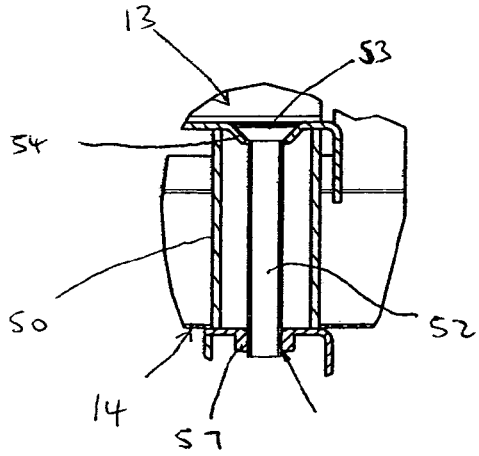

SEPARATING FOREIGN OBJECTS FROM A MASS OF COINS

CROSS-REFERENCE TO RELATED APPLICATIONS

This application claims priority to U.S. provisional patent application Ser. No. 60/414,486, filed on Sep. 27, 2002 and to U.S. provisional patent application Ser. No. 60/448,323, filed on Feb. 19, 2003. This application also claims priority to U.K. application number GB 0222439.2, filed on Sep. 27, 2002 and to U.K. application number GB 0303434.5, filed on Feb. 14, 2003.

INCORPORATION BY REFERENCE

The specifications of U.S. provisional patent application Ser. No. 60/414,486 and U.S. provisional patent application Ser. No. 60/448,323 are incorporated herein in their entirety, by this reference. The specifications of U.K. patent application number GB 0222439.2 and U.K. patent application number GB 0303434.5 are incorporated herein in their entirety, by this reference.

FIELD OF THE INVENTION

The present invention relates to apparatus and method for separating foreign objects from a mass of coins.

The term 'coin' will be used herein to include coin-like articles such as tokens, and blanks.

BACKGROUND OF THE INVENTION

The present invention stems from a need to separate foreign objects from a mass of coins inserted into a machine, often by the public, in order to provide a total value of the coins. Such machines are increasingly being provided in public places, such as supermarkets to enable the public to dispose of their small change.

It should, however, be appreciated that the invention is not restricted to use in such self-service bulk coin counters but may have use in other coin-handling machines in situations where the coins inserted into the machine may have mixed with them foreign objects of various kinds.

In the absence of a separation device, the foreign objects are liable to jam the machine, or reduce the efficiency of the machine.

The foreign objects can be of various kinds such as fluff and all manner of items which are found in pockets and purses, such as pencils, buttons and pens, lipsticks etc, in short any item that can get picked up inadvertently with a batch of coins when the coins are loaded into a coin sorting/counting machine by a member of the public. In an industrial situation, such as a mint, contaminants of various kinds can arise, such as maize, shot and other abrasive and cleaning media.

Various types of coin cleaning devices for cleaning a mass of coins, prior to it being processed by a coin processing device, are known.

U.S. Pat. No. 5,482,916 discloses a coin conditioning device comprising a rotatable container, having perforated walls and vanes for causing the mass of coins to be conveyed forward through the container. The described coin conditioning device works like a screw tube conveyor, causing the mass of coins to tumble inside the conveyor, while non-coin matter is allowed to fall out of the container through the perforations in the walls.

WO 96/30877 discloses a similar, rotatable coin cleaning device, wherein the vanes are replaced by a screw conveyor that is arranged inside the perforated container.

The present invention stems from some work to provide a coin cleaning device which is fast and which provides an even flow of coins to the components downstream of the coin cleaning device.

SUMMARIES OF THE INVENTION

According to one aspect of the invention a coin cleaning device for separating foreign objects from a mass of coins inserted into the device, comprises a coin receiving means into which a batch of coins may be inserted, an elongate tray assembly, an inlet end of the tray assembly being so arranged as to receive coins from the coin receiving means, a vibration means connected to the tray assembly and so arranged as in use to cause coins on the tray assembly to travel along the tray assembly in the direction away from said inlet end, the tray assembly comprising upper and lower shelves which are substantially horizontal in use, the upper shelf comprising a first upper shelf portion and a second upper shelf portion, the first upper shelf portion being disposed towards said inlet end, and the second upper shelf portion being disposed away from said inlet end, the first upper shelf portion being perforated by apertures of transverse dimensions smaller than the minimum diameter of coins to be handled by the device, whereby some foreign matter of transverse dimensions smaller than the perforations can fall through the perforations of the first upper shelf portion, the second upper shelf portion being formed with coin receiving apertures of transverse dimensions larger than the maximum diameter of coins to be handled by the device, whereby coins which travel from on top of the first upper shelf portion to the second upper shelf portion fall through said coin receiving apertures, the lower shelf extending beneath the second upper shelf portion and being provided with perforations of transverse dimensions smaller than the minimum diameter of coins to be handled by the device whereby any foreign objects which are associated with coins that tumble through the apertures of the second upper shelf portion, can pass through the lower shelf, as the coins are conveyed along the lower shelf, and a coin outlet positioned to receive coins from the downstream end of the lower shelf.

Such a device provides two cleaning steps for the coins, the first step being associated with the passage of the coins along the first upper shelf portion, and the second step being associated with the passage of the coins along the lower shelf. Moreover, in falling through the upper shelf and down onto the lower shelf the coins are tumbled which can help to separate any remaining foreign matter from the coins so as to encourage that foreign matter then to fall through the perforations of the lower shelf.

The device may comprise an additional shelf portion in said coin outlet, said additional shelf portion being perforated with apertures of transverse dimensions smaller than said minimum coin diameter.

The device preferably comprises a large object collection means adapted to collect any objects that are sufficiently large as not to fall through the apertures of the second upper shelf portion.

The large object collection means preferably comprises a chute which is open to the downstream end of the second upper tray portion and extends downwards to a bin, which is conveniently the reject cup in a coin sorter.

The bin is preferably located behind a door of the machine for easy emptying of the bin as and when required, or the bin may be permanently accessible through an opening in an external panel of the machine.

One advantageous construction of said elongate tray assembly comprises a self-contained upper tray spaced from a self-contained lower tray by a plurality of rigid spacers, each spacer being associated with a respective releasable fastener, the arrangement being such that when the fasteners are in a secured condition the upper tray is rigidly connected to the lower tray by said spacers and fasteners, and when the fasteners are released the upper tray is removable from the lower tray.

The associated spacers and fasteners are preferably located substantially at opposite ends of the upper tray.

The combined mass of the spacers and fasteners at one end of the upper tray can be arranged to be different from the combined mass of the spacers and fasteners at the other end of the upper tray, in order to provide differing vibration characteristics of the tray assembly along the length thereof.

Desirably the combined mass of the spacers and fasteners at the upstream end of the tray assembly is chosen relative to the combined mass of the spacers and fasteners of the downstream end so as to cause coins to become more spaced-apart as they proceed along the tray assembly, and thereby helps to avoid a sudden surge of coins reaching the outlet.

The spacers at the downstream end preferably comprise a hollow column, and the fastener extends through the bore of the column.

The spacers at the upstream end are conveniently constituted by a single block which extends transversely across the tray assembly, a plurality of laterally-spaced apart fasteners extending through respective bores provided in the block.

The block can be provided with apertures sized according to the required mass of the block.

According to a second aspect of the invention we provide a coin cleaning device for separating foreign objects from a mass of coins, comprising at least two shelf portions arranged at different heights, vibration means for vibrating the shelf portions to cause coins on the shelf portions to be conveyed along the shelf portions, said shelf portions each being perforated by apertures of transverse dimensions smaller than the minimum diameter of coins to be handled by the device, whereby foreign matter of transverse dimensions smaller than the perforations can fall through the perforations, the shelf portions being arranged in series with one another, such that coins conveyed along a first of the shelf portions then tumble downwards to lie on the second shelf portion and are then conveyed along the second shelf portion to a coin outlet.

According to a third aspect of the invention a coin sorting and/or counting machine is provided with a coin cleaning device in accordance with the first or second aspect of the invention, the coin outlet of the device leading into the coin sorter and/or counter of the machine.

The machine preferably comprises a coin sorter and/or counter of the inclined disc type in which coins to be counted and/or sorted are held in a hopper and are picked out in turn by the disc.

Preferably the hopper is disposed to one side of the elongate tray assembly, as viewed in plan, and a coin delivery chute, directed substantially transversely of the tray assembly, conveys coins falling from the downstream end of the lower shelf into the hopper. This enables the tray assembly to be located towards the front of the machine, which can improve accessibility to the tray assembly for maintenance, and facilitates the coin receiving means being located towards the front of the machine.

Any other known type of coin sorter and/or counter may benefit from the inventive coin cleaning device being arranged to clean the coins before they are handled by the sorter/counter.

According to a fourth aspect of the invention a method of separating foreign bodies from a mass of coins comprises causing the coins to be vibrated along an upper shelf portion provided with perforations of a dimension smaller than the minimum diameter of coins to be handled, causing the coins to tumble from the downstream end of the upper shelf portion onto a lower shelf portion, said lower shelf portion also being provided with perforations of a dimension smaller than the minimum diameter of coins to be handled, and being vibrated to cause the coins to travel along the lower shelf portion, collecting foreign objects that have fallen through the perforations of either the upper shelf portion or the lower shelf portion, and collecting the cleaned coins dispensed from the downstream end of the lower shelf portion.

The various aspects of the invention will now be further described, by way of example only, with reference to the accompanying drawings in which:

BRIEF DESCRIPTION OF THE DRAWINGS

FIG. 11 is a section on the line 11-11 of FIG. 9;

FIG. 12 is a section on the cranked line 12-12 of FIG. 9; and

FIG. 13 is an enlargement, on a scale of 2:1, of the portion of FIG. 12 indicated in broken outline by the arrow B.

DESCRIPTION OF PREFERRED EMBODIMENTS

Figure 1:
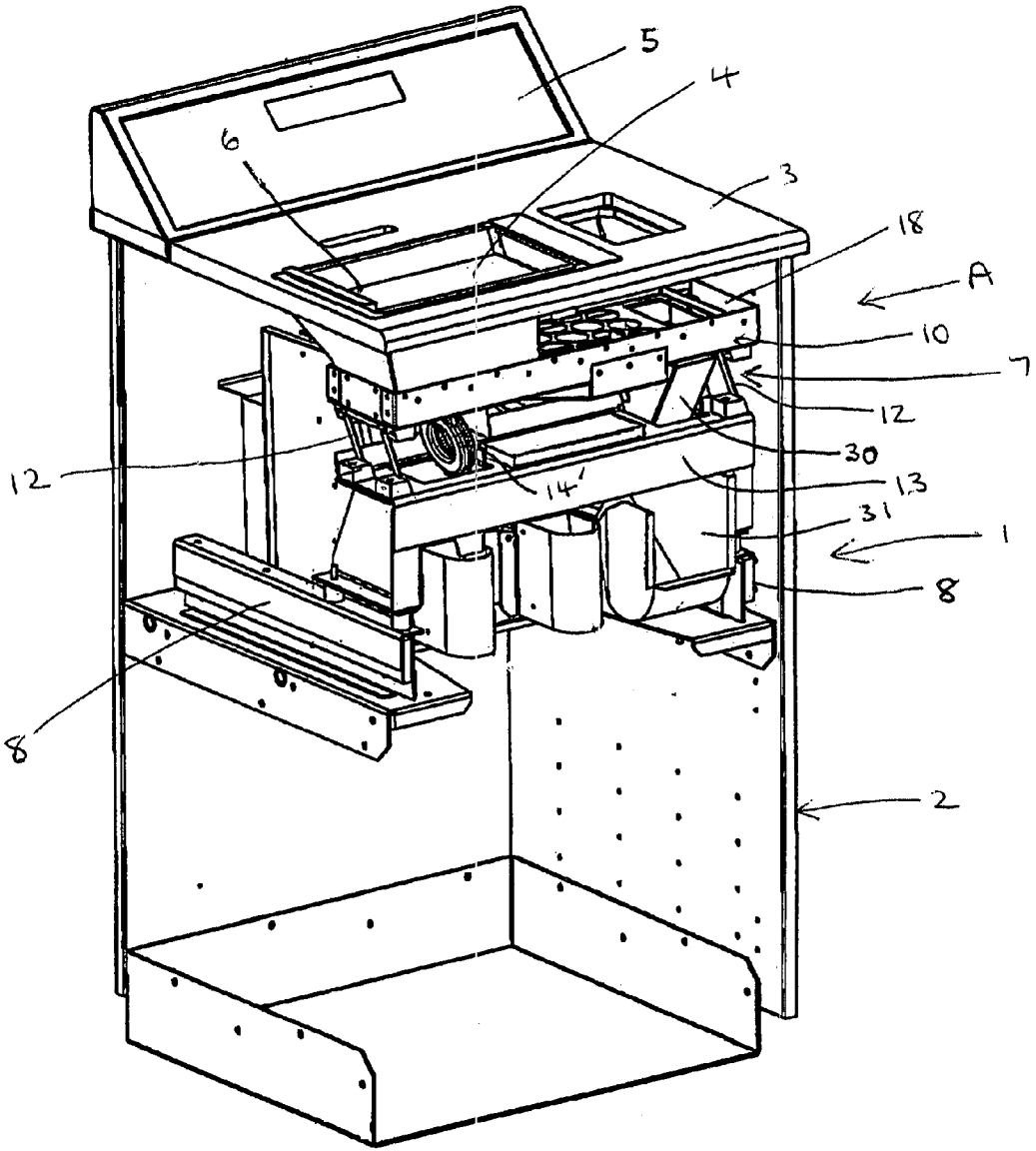
FIG. 1 is a perspective partial view of a batch coin sorter and counter machine provided with a coin cleaning tray assembly in accordance with the invention, the machine being shown with front and side outer panels removed.
Figure 2:
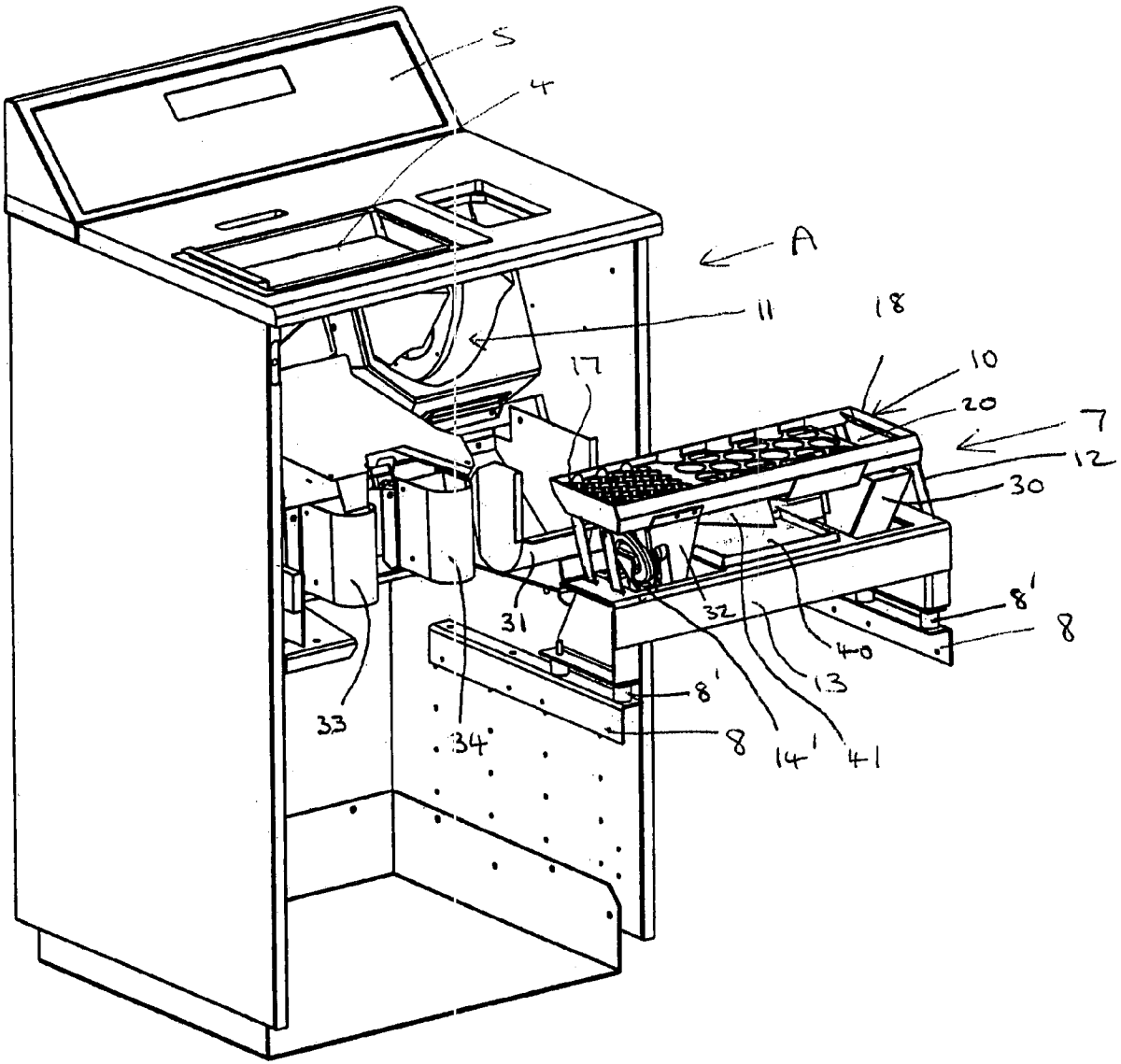
FIG. 2 is a view of the machine with the coin tray assembly disassociated from the machine to reveal the hopper coin sorter and counter.
Figure 7:
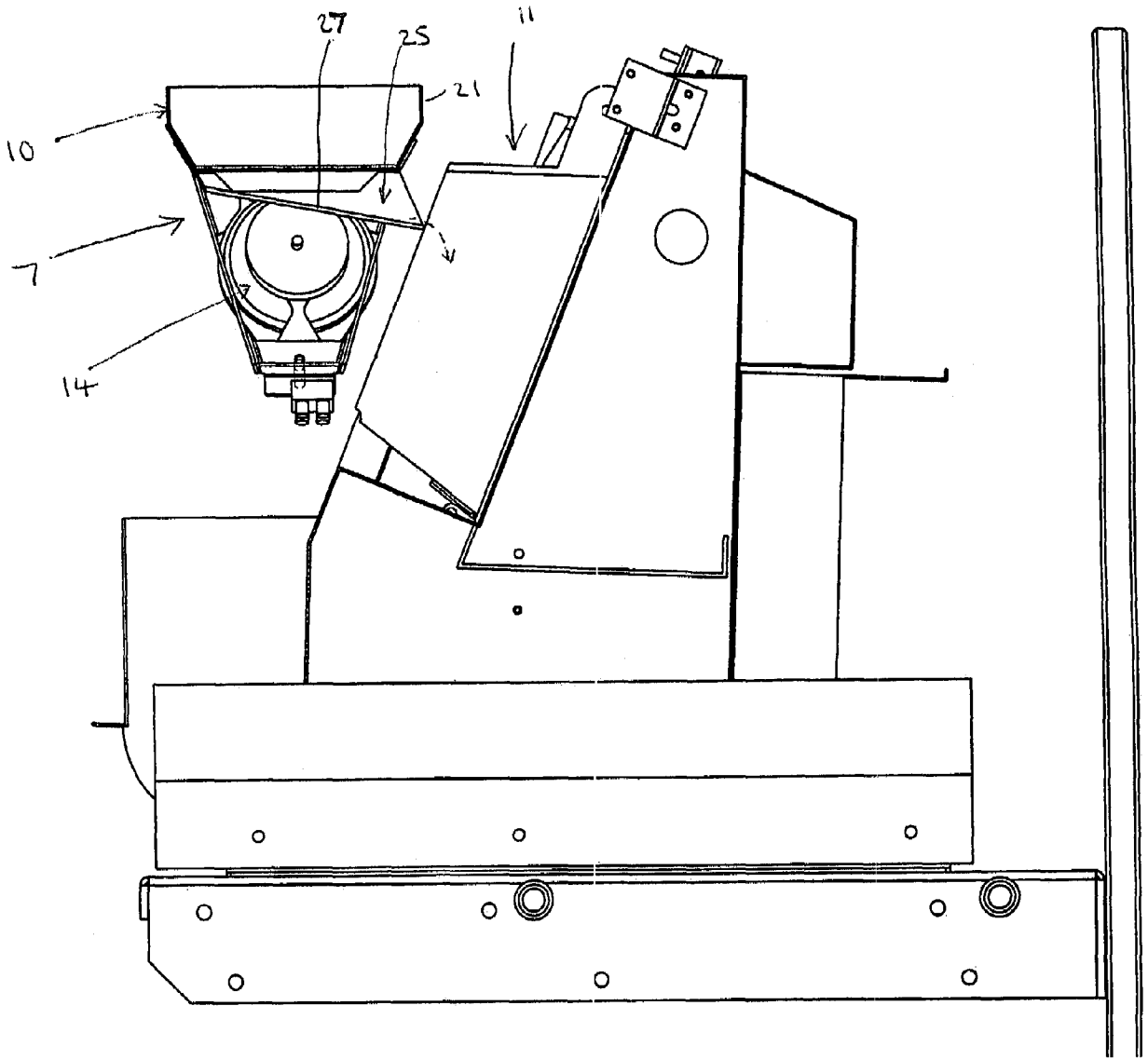
FIG. 7 is an end elevation of the hopper and tray assembly of the machine of FIG. 1, looking in the direction of the arrow A in FIG. 1 but with a machine side panel removed.

With reference to FIGS. 1, 2 and 7, a coin sorting and counting machine 1 comprises an upright rectangular housing 2 closed at its upper end by a top panel 3 formed with a coin receiving recess 4 into which a customer can place a batch of coins. At the left hand end of the recess 4, in FIG.

1, this is a large slot 6 into which the user can brush coins from the recess 4 in order to direct the coins into the machine for counting.

A coin cleaning assembly 7 comprising an elongate tray assembly 10 is disposed below the top panel 3 and is mounted on drawer slides 8 to enable the entire coin cleaning assembly 7 to be drawn forwards from the operative position shown in FIG. 1, when the front panel (not shown) of the machine is opened.

As shown in FIGS. 2 and 7 a coin sorter and counter assembly 11 of the well-known hopper type is positioned at a lower level of the machine than the tray assembly 10 and is disposed rearwardly of the coin cleaning assembly 7.

Figure 3:
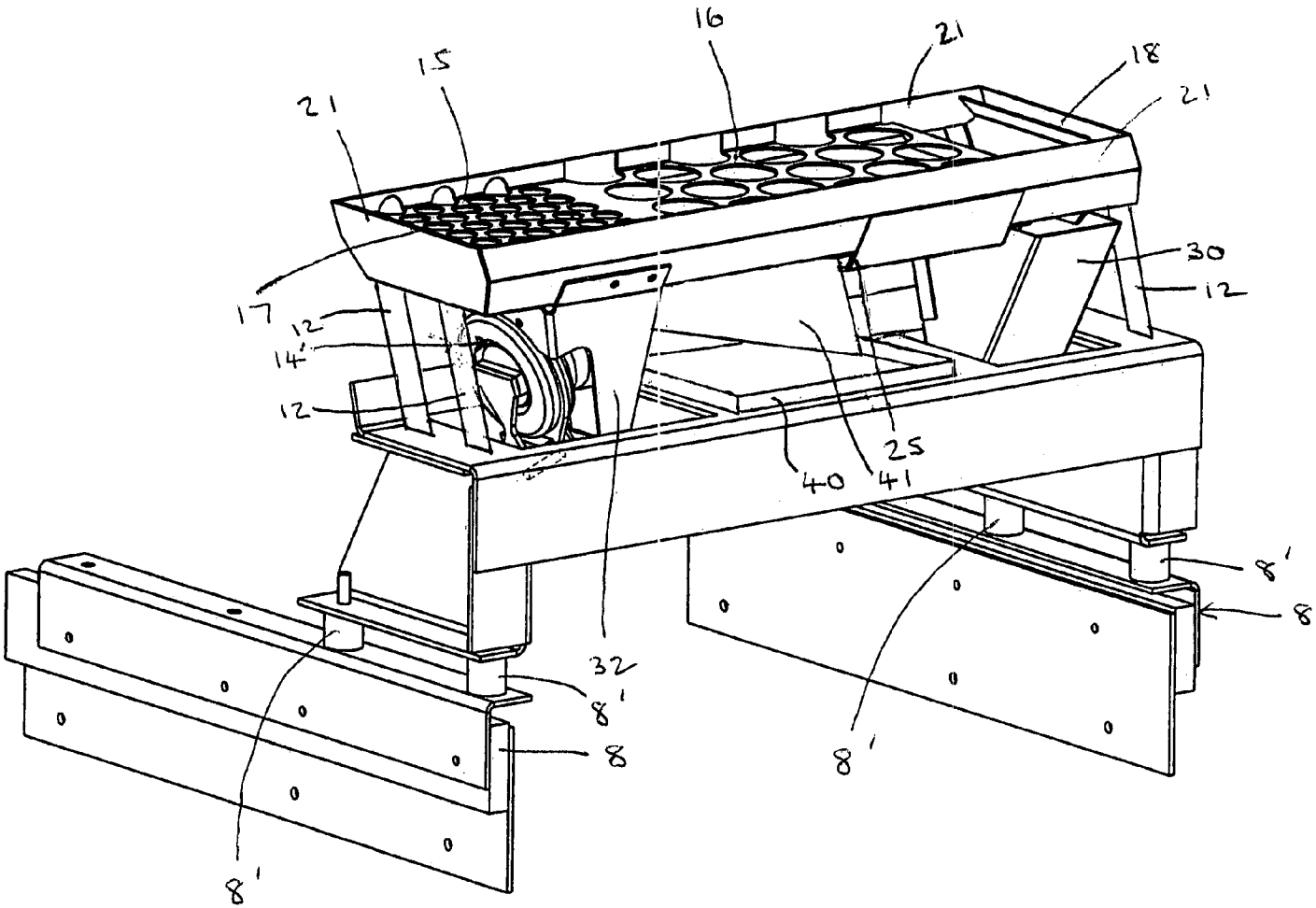
FIG. 3 is an enlarged perspective view of the coin tray assembly of the machine of FIG. 1.

Tray assembly 10 is supported at opposite ends thereof on resilient supports 12 above a rigid chassis 13, and a vibration means 14' of well-known type is arranged to act between the chassis 13 and the tray assembly 10 to cause the tray assembly to be vibrated in a manner such that coins on the tray assembly are caused to be conveyed along the tray assembly from the left hand end in FIGS. 1, 2 and 3 towards the right hand end.

This is achieved, in a known manner, by arranging the axis of the excitation means 14' to be directed upwardly at an acute angle to the longitudinal axis of the tray assembly.

The vibration means 14' comprises a coil and an armature assembly mounted on a vibrator yoke 32 secured to the underside of the tray assembly, The coil may be energised at mains frequency, either using a mains voltage AC. power supply, or at a reduced voltage by use of a transformer.

It is preferably arranged that the vibration means 14' vibrates the tray assembly at a frequency close to, but not at, the resonant frequency of the tray assembly. For example, if the resonant frequency is 65 cps then a vibration frequency of about 62 cps would be optimum. An adjustment means could be provided to adjust the resonant frequency of the tray assembly. Alternatively, an adjustable frequency converter could be provided in the supply to the coil of the vibration means 14'.

As is known to the skilled person in the vibrating conveyor field, the axis of the vibrating coil is preferably arranged to extend substantially through the centre of gravity of the tray assembly 10 so as to help minimise the transmission of vibrations to other parts of the machine. This is assisted by anti-vibration rubber mountings 8'.

With reference to FIGS. 3 to 6, the tray assembly comprises upper and lower perforated shelves 13 and 14 respectively which both extend substantially horizontally. The upper shelf 13 comprises a first upper shelf portion 15 extending from the upstream end 17 of the tray assembly, and a second coplanar upper shelf portion 16 extending from the downstream end of the first upper shelf portion 15 towards the downstream end 18 of the tray assembly.

Beyond the downstream end of the second upper shelf portion 16 there is disposed a large rectangular aperture 20 for receipt of any very large foreign bodies, those which are too large to pass through the apertures of the second upper tray portion 16.

In order to prevent coins falling sideways from the upper shelf 17, upstanding sidewalls 21 extend around the upper shelf 17.

A lower tray wall 22 is disposed beneath the first upper shelf portion 15 in order to collect foreign matter which falls through perforations 23 in said portion 15. The perforation 23 are chosen to be of a diameter that is less than a predetermined minimum diameter of coins to be fed to the coin hopper 11, so that coins to be sorted and counted do not pass to the foreign bodies outlet 23 leading from the downstream end of lower tray wall 22.

The second upper shelf portion 16 is formed with apertures of a diameter that is larger than the predetermined maximum diameter of coins to be handled by the coin sorter/counter 11, so that all such coins which pass from the downstream end of the first shelf portion 15 ultimately fall through one or another hole in the second upper shelf portion 16. Most coins will tumble through the first few holes encountered in the second upper tray portion 16 to tumble downwards and land on the lower shelf 14, or onto other coins already thereon.

Figure 4:
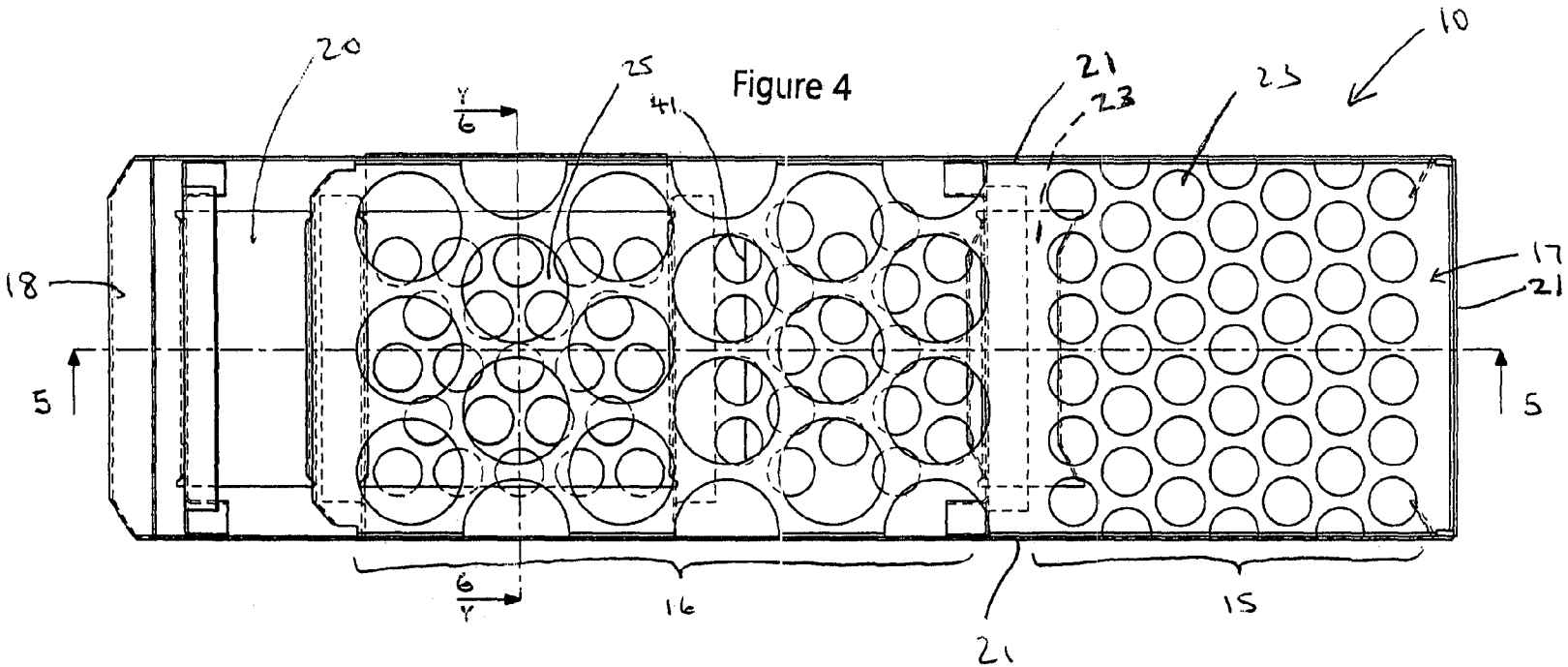
FIG. 4 is a plan view of the coin tray assembly.
Figure 5:
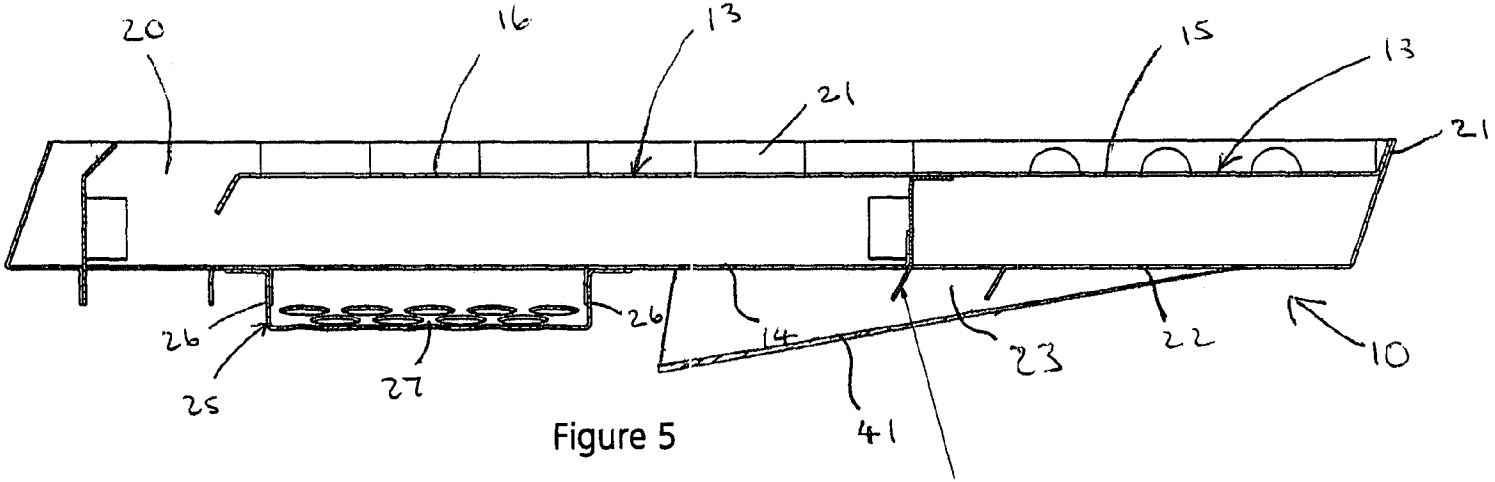
FIG. 5 is a longitudinal vertical cross-section of the coin tray unit on the line 5-5 of FIG. 4.

Lower shelf 14 is perforated by apertures of similar dimensions to those of the first upper shelf portion 15, to enable any remaining small foreign items to fall through the apertures of the lower shelf 14 as the coins travel along the lower shelf 14, the coins proceeding to the left in FIGS. 4, 5.

Figure 6:
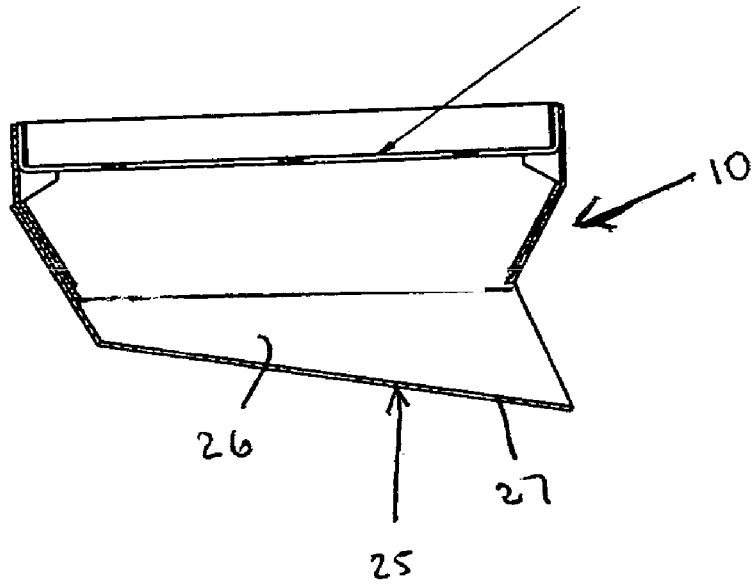
FIG. 6 is a transverse cross section of the tray unit on the line 6-6 of FIG. 4.

As shown in FIGS. 5 and 6, a coin delivery chute 25 is positioned at the downstream end of the lower shelf 14. Delivery chute 25 is of square outline in plan and comprises substantially triangular vertical side walls 26, and a sloping base 27 which is perforated with holes of a diameter similar to those in first upper shelf portion 15 and those in lower shelf 14, for the same purpose of permitting small foreign bodies to fall through the base 27.

The slope of the base 27 causes coins to slide sideways down the chute 25 to be directed into the hopper 11, as can be seen from FIG. 7.

A removable foreign matter collection tray 40, FIG. 3, is positioned in the machine beneath the tray assembly 10 to collect the foreign matter which falls through the various portions of the tray assembly. A foreign matter collection chute 41, best seen in FIGS. 3 and 5, extends below opening 23 and beneath shelf portion 14 to direct foreign matter from shelf portions 15 and 14 into the tray 40.

A large item chute 30, FIG. 3, leads to a large item bin 31, FIG. 1, which is readily accessible at the front of the machine, either on opening of a front panel of the machine, or if desired through an opening provided in the front panel, in which case bin 31 may simply be the coin reject cup of the machine.

The illustrated construction of tray assembly provides a compact structure that is effective to separate foreign matter from a mass of coins introduced through the inlet slot 6 of the machine. There are no rotating parts that could become jammed, yet the coins are subject to many oscillations in travelling from the inlet slot 6 to the outlet of chute 27. Furthermore the coins are tumbled in passing from the upper shelf to the lower shelf, and many coins will also tumble in passing from the lower shelf 14 to the chute 27, all helping to separate foreign items from the coins.

Figure 8:
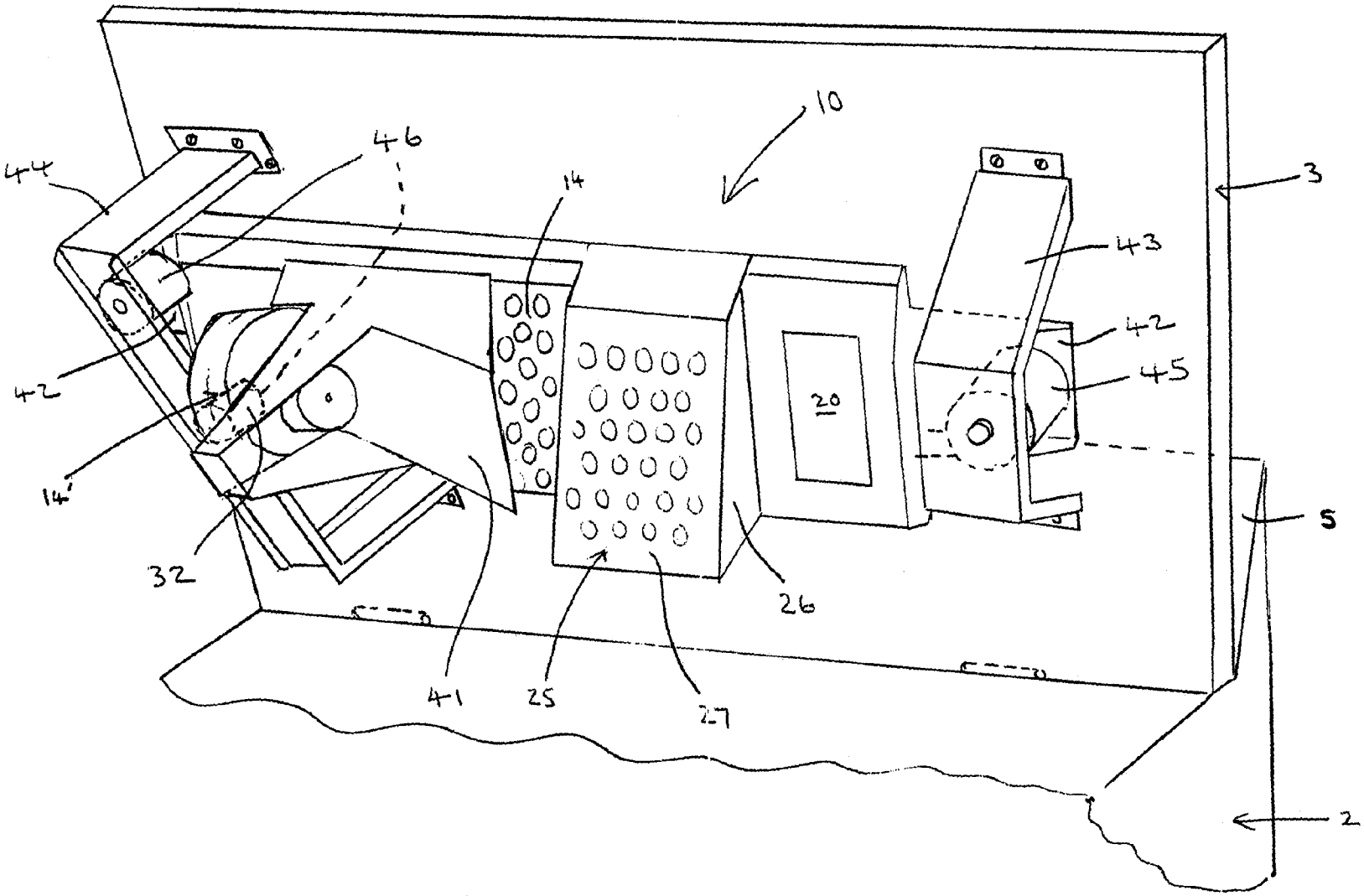
FIG. 8 is a schematic perspective view of a modification in which the coin tray assembly is suspended on anti-vibration mountings from the lid of the machine, the view showing the lid in a fully raised condition.
Figure 9:
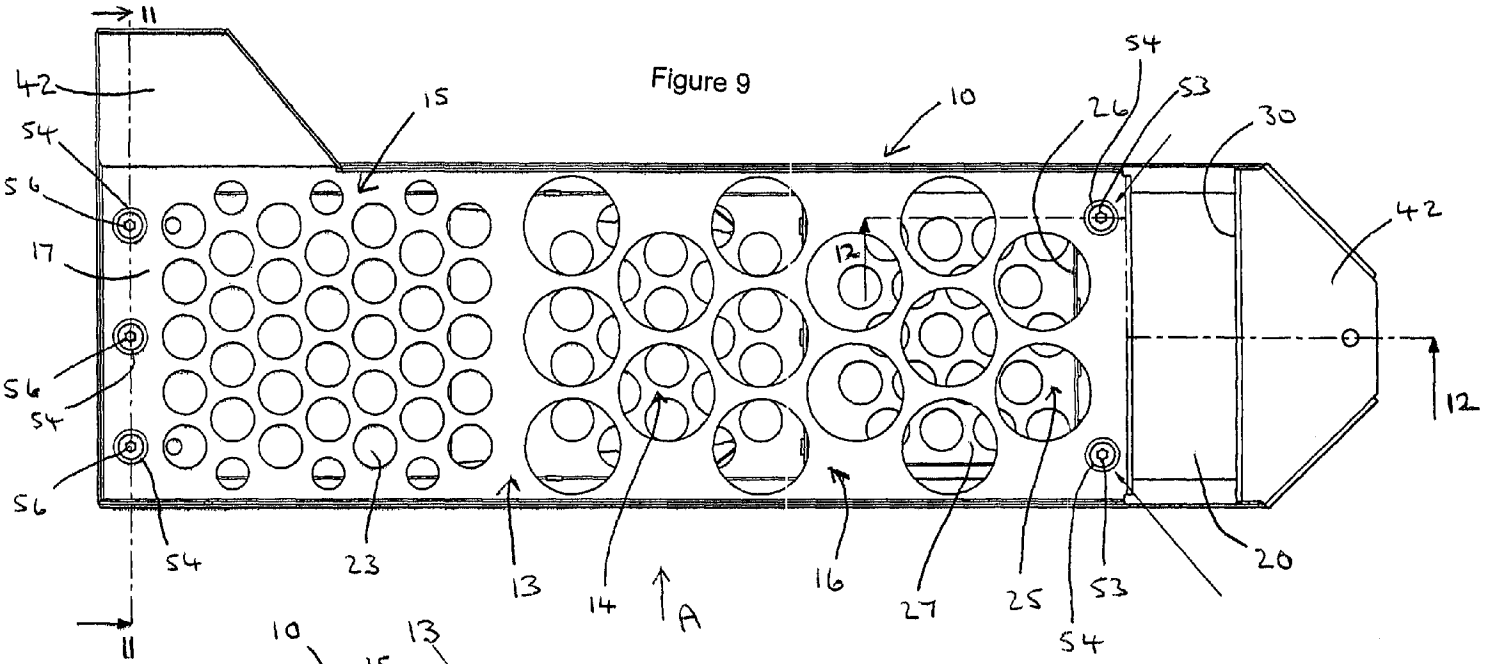
FIG. 9 is a plan view of a modified assembled tray assembly in accordance with the present invention and shown in an assembled condition.
Figure 10:
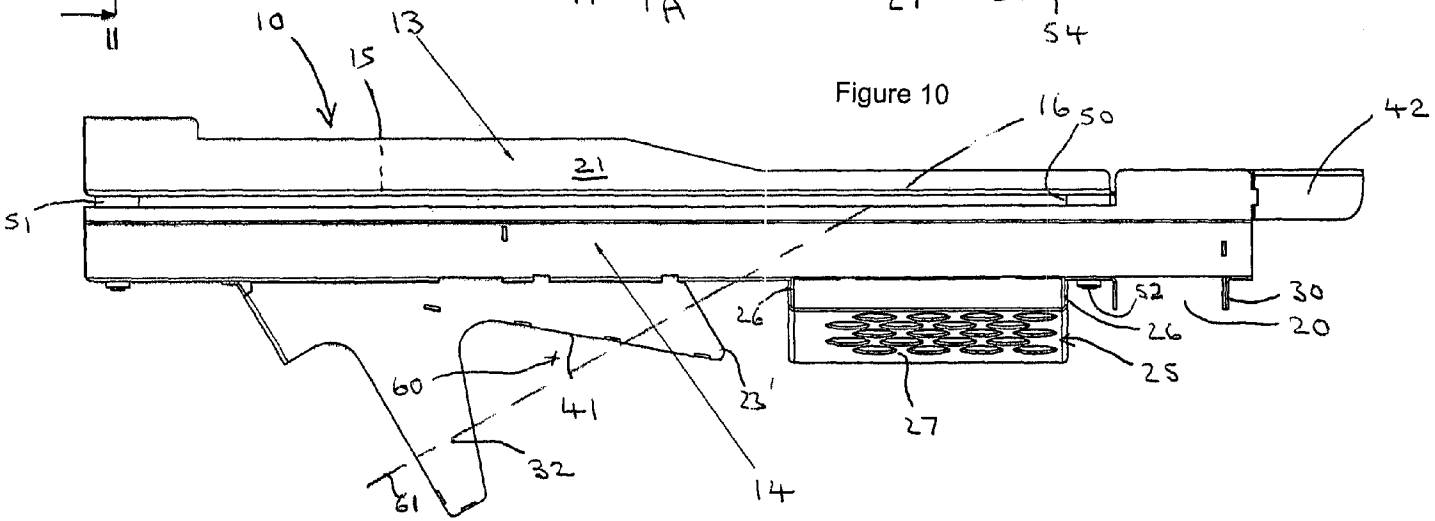
FIG. 10 is a side elevation of the assembled tray assembly looking in the direction of the arrow A in FIG. 9.

FIG. 8 shows a modified arrangement for supporting a tray assembly which is otherwise substantially the same as the tray assembly of FIG. 3, and like reference numerals have been applied to like parts.

In the FIG. 8 construction, the entire tray assembly 10 is suspended from the machine lid 3, opposite ends of the try assembly carrying mounting lugs 42 which are connected to respective yokes 43, 44 by way of three resilient mountings 45, 46 respectively.

This mounting arrangement for the tray assembly helps to isolate the remainder of the machine from vibrations, and also enables the underside of the tray assembly to be readily accessed, simply by raising the pivoted lid 3, as shown in FIG. 8.

In FIGS. 9 to 13, parts corresponding to those of the tray assembly of FIGS. 3 to 6 have been given corresponding reference numerals.

As shown in the drawings the tray assembly comprises an upper elongate tray 13 rigidly supported above a lower elongate tray 14 by means of spacers 50, 51. Each tray 13, 14 is of shallow trough shape in transverse section.

The spacers 50 at the downstream end of the upper tray 13 are in the form of tubular pillars and are clamped between the undersurface of upper tray 13 and the upper surface of lower tray 14 by respectively associated screws 52 which extend through the bores of the spacers 50. The screw heads 53 are received in complementary recesses defined in the upper surface of tray 13 by frusto-conical formations 54 such that the screw heads 53 do not protrude above the base of tray 13.

At the upstream ends of the trays 13 and 14 they are rigidly spaced apart by an oblong-rectangular spacer block 51 which extends transversely across the trays 13, 14 and is provided with three stepped vertical bores 55 to receive respective screws 56 similar to screws 52.

Screws 52 and 56 are threadedly engaged at their lower ends in downwardly projecting tubular bosses 57 pressed from the material of the base of lower tray 14.

A suitable proprietary screw locking material is used to prevent the screws 52 and 56 from vibrating loose in use of the tray assembly.

The relative masses of the spacers 50 and 51 are chosen so as to provide a difference in the vibration characteristics of the trays 13, 14 in proceeding from the upstream end of the trays. In particular, the downstream end of the trays will tend to jump more than the upstream end and will cause the coins to become more spaced apart in the longitudinal direction of the trays, as the coins move along the trays. This is due to the centre of gravity 60, FIG. 2, of the tray assembly being located rearwards of the line of action 61 of the vibrator.

The ability to disconnect the upper tray from the lower tray enables different trays to be used for handling different ranges of coins, the holes in the trays being chosen according to the diameter of the coins to be handled.

Instead of employing screws as the fasteners, it may be desirable in some cases to employ quick-release clamps.

What is claimed is:

1. A coin cleaning device for separating foreign objects from a mass of coins inserted into the device, said device comprising coin receiving means into which a batch of coins may be inserted, an elongate tray assembly, an inlet end of the tray assembly being so arranged as to receive coins from said coin receiving means, a vibration means connected to said tray assembly and so arranged to cause coins on the tray assembly to travel along the tray assembly in the direction away from said inlet end, the tray assembly comprising an upper shelf and a lower shelf which are substantially horizontal, said upper shelf comprising a first upper shelf portion and a second upper shelf portion, said first upper shelf portion being disposed towards said inlet end, and said second upper shelf portion being disposed away from said inlet end, said first upper shelf portion being perforated by apertures of transverse dimensions smaller than a predetermined minimum diameter of coins to be handled by the device, whereby some foreign matter of transverse dimensions smaller than said perforations can fall through said perforations of said first upper shelf portion, said second upper shelf portion being formed with coin receiving apertures of transverse dimensions larger than a predetermined maximum diameter of coins to be handled by the device, whereby coins which travel from on top of said first upper shelf portion to said second upper shelf portion fall through said coin receiving apertures, said lower shelf extending beneath said second upper shelf portion and being provided with perforations of transverse dimensions smaller than said pre-determined minimum diameter of coins whereby any foreign objects which are associated with coins that tumble through said apertures of said second upper shelf portion can pass through said lower shelf, as the coins are conveyed along said lower shelf, a downstream end of said lower shelf, and a coin outlet positioned to receive coins from said downstream end of said lower shelf.

2. A device as in claim 1 comprising an additional shelf portion in said coin outlet, said additional shelf portion being perforated with apertures of transverse dimensions smaller than said minimum coin diameter.

3. A device as in claim 1 comprising a large object collection means positioned to collect any objects that are sufficiently large as not to fall through said apertures of said second upper shelf portion.

4. A device as in claim 3 wherein said large object collection means comprises a chute which is open to the downstream end of said second upper tray portion and extends downwards to a bin.

5. A device as claimed in claim 4 in which said bin is a reject cup of a coin sorter.

6. A device as claimed in claim 1 wherein said upper shelf is in the form of a self-contained upper tray, and said lower shelf is in the form of a self-contained lower tray, and wherein said upper tray is spaced from said lower tray by a plurality of rigid spacers, each spacer being associated with a respective releasable fastener, the arrangement being such that when the fasteners are in a secured condition the upper tray is rigidly connected to the lower tray by said spacers and fasteners, and when the fasteners are released the upper tray is removable from the lower tray.

7. A device as in claim 6 wherein said associated spacers and fasteners are located substantially at opposite ends of said upper tray.

8. A device as in claim 7 wherein the combined mass of said spacers and fasteners at said inlet end of the tray assembly is chosen relative to the combined mass of the spacers and fasteners of the downstream end, whereby coins become more spaced-apart as they proceed along said upper and lower trays.

9. A device as claimed in claim 8 wherein said spacers at the downstream end comprise a hollow column having a bore, and the fastener extends through said bore of said column.

10. A device as claimed in claim 8 wherein said spacers at the upstream end are constituted by a single block which extends transversely across the tray assembly and is provided with a plurality of bores, a plurality of laterally-spaced apart fasteners extending through respective bores.

11. A coin cleaning device for separating foreign objects from a mass of coins inserted into the device, said device comprising a coin receptor, an elongate tray assembly, an inlet end of the tray assembly being so arranged to receive coins from said coin receptor, a vibrator connected to said tray assembly, the tray assembly comprising an upper shelf and a lower shelf which are substantially horizontal, said upper shelf comprising a first upper shelf portion and a second upper shelf portion, said first upper shelf portion being disposed towards said inlet end, and said second upper shelf portion being disposed away from said inlet end, said first upper shelf portion being perforated by apertures of transverse dimensions smaller than a predetermined minimum diameter of coins to be handled by the device, whereby some foreign matter of transverse dimensions smaller than said perforations can fall through said perforations of said first upper shelf portion, said second upper shelf portion being formed with coin receiving apertures of transverse dimensions larger than a predetermined maximum diameter of coins to be handled by the device, said lower shelf extending beneath said second upper shelf portion and being provided with perforations of transverse dimensions smaller than said pre-determined minimum diameter of coins, a downstream end of said lower shelf, and a coin outlet positioned to receive coins from said downstream end of said lower shelf.

12. A coin counting machine for providing a value of a batch of coins inserted into the machine, said machine comprising a machine cabinet, a hopper housed within said cabinet, a coin feeder within said cabinet for feeding coins from said hopper, a coin discriminator housed within said cabinet for discriminating coins fed by said coin feeder, and a coin value summation means responsive to said coin discriminator for providing a total value of said coins fed by said coin feeder, wherein said coin counting machine comprises a coin cleaning device as claimed in claim 1 housed within said cabinet, said coin outlet of said coin cleaning device being positioned to direct coins into said hopper.

13. A coin counting machine as in claim 12 wherein said first and second shelf portions are portions of an elongate tray assembly.

14. A coin counting machine as claimed in claim 13 wherein said cabinet comprises a front wall and a rear wall, said hopper is disposed in said cabinet towards said rear wall, and said tray assembly is disposed towards said front wall, said coin outlet of said coin cleaning device being directed substantially transversely of said tray assembly, towards said rear wall.

15. A coin counting machine as claimed in claim 14 wherein said cabinet comprises a top wall formed with an aperture in a position towards said front wall of said cabinet, said aperture opening to said first shelf portion of said tray assembly.

16. A method of separating foreign objects from a mass of coins, said method comprising causing the coins to be vibrated along an upper shelf having a first upper shelf portion provided with perforations of a transverse dimension smaller than a predetermined minimum diameter of coins to be handled and a second upper shelf portion provided with coin receiving apertures of a transverse dimension larger than a predetermined maximum diameter of coins to be handled, causing the coins to pass through the coin receiving apertures in the second upper shelf portion onto a lower shelf, said lower shelf also being provided with perforations of a transverse dimension smaller than said predetermined minimum diameter of coins to be handled and being vibrated to cause the coins to travel along said lower shelf portion, collecting foreign objects that have fallen through said perforations in the first upper shelf portion and the lower shelf, and collecting coins dispensed from the a downstream end of said lower shelf.

* * * * *